US005900302A

United States Patent [19]

Minato

[11] Patent Number: 5,900,302

[45] **Date of Patent: *May 4, 1999**

[54] MOLDED SURFACE FASTENER HAVING AN ORNAMENTAL PATTERN, AND METHOD OF AND APPARATUS FOR MANUFACTURING SAME

[75] Inventor: Tsuyoshi Minato, Toyama-ken, Japan

[73] Assignee: YKK Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/725,097

[22] Filed: Oct. 2, 1996

[30] Foreign Application Priority Data

Oct. 2, 1995 [JP] Japan ..... 7-254845

[51] Int. Cl.[6] ..... A44B 18/00

[52] U.S. Cl. ..... 428/99; 428/100; 428/195; 428/156; 24/442

[58] Field of Search ..... 428/99, 100, 195, 428/156; 24/442, 446, 452

[56] References Cited

U.S. PATENT DOCUMENTS

| | | | |
|---|---|---|---|
| 2,499,898 | 3/1950 | Anderson | 24/452 |
| 3,408,705 | 11/1968 | Kayser et al. | 24/452 |
| 4,794,028 | 12/1988 | Fischer | 428/100 |
| 4,872,243 | 10/1989 | Fisher | 24/442 |
| 5,606,781 | 3/1997 | Provost et al. | 24/452 |

FOREIGN PATENT DOCUMENTS

| | | |
|---|---|---|
| 0 209 120 | 1/1987 | European Pat. Off. . |
| 0 210 536 | 2/1987 | European Pat. Off. . |
| 0 574 863 | 12/1993 | European Pat. Off. . |
| 0 719 507 | 7/1996 | European Pat. Off. . |
| WO 93/03644 | 3/1993 | WIPO . |
| WO 96/25063 | 8/1996 | WIPO . |
| WO 96/27307 | 9/1996 | WIPO . |

*Primary Examiner*—Alexander Thomas
*Attorney, Agent, or Firm*—Hill & Simpson

[57] ABSTRACT

A molded surface fastener having on its engaging surface an ornamental pattern, such as characters, design, symbol, etc., which is devoid of engaging elements. This ornamental pattern is formed using a die wheel having a multiplicity of engaging-element-forming cavities arranged on the entire circumferential surface except an ornamental pattern of area.

9 Claims, 10 Drawing Sheets

MOLDED SURFACE FASTENER HAVING AN ORNAMENTAL PATTERN, AND METHOD OF AND APPARATUS FOR MANUFACTURING SAME

BACKGROUND OF THE INVENTION

1. Field of the Invention

This invention relates to a synthetic resin molded surface fastener having a multiplicity of engaging elements on an engaging surface of a substrate sheet and a method of manufacturing the molded surface fastener, and more particularly to a molded surface fastener having an ornamental pattern formed on its front or front and rear surfaces simultaneously with the molding and a method of and an apparatus for manufacturing the molded surface fastener.

2. Description of the Related Art

In manufacturing woven and knit fiber surface fasteners to be used as opening and closing means for garments, bags, etc. as well as detachably attaching means such as fastening bands, various attempts have been made to improve the fashionability of products using surface fasteners. To this end, it has been a common practice to form an ornamental pattern, such as characters, design, symbol, etc. on the surface fastener's engaging surface, from which a multiplicity of hooks or loops as engaging elements stand, in an effort to give the surface fastener a good external view.

For example, according to Japanese Patent Publication No. Hei 3-79001, an ornamental pattern, such as characters, design, symbol, etc., is formed on the engaging surface of a surface fastener by press-heating and solidifying soft and flexible material, such as silicone rubber, onto the engaging surface, on which a multiplicity of engaging elements in the form of hooks or loops stand, of the surface fastener.

Further, according to Japanese Patent Laid-Open Publication No. Sho 62-19105, a desired pattern, such as desired characters, design, symbol, etc., of dye paste is stamped on the rear surface, which is opposite to the engaging surface, of a surface fastener and sucking the dye paste on the rear surface to the engaging surface by a vacuum pump disposed on the side of the engaging surface of the surface fastener. Then the resulting surface fastener is treated with a dyeing process so that characters, design, symbol, etc. come out on the engaging surface of the surface fastener.

Japanese Patent Laid-Open Publication No. Hei 3-69658 discloses a method of and an apparatus for dyeing a surface fastener. According to this disclosure, a desired pattern, such as characters, design, symbol, etc., is formed by spouting ink drops over the engaging surface of a surface fastener in a dot-matrix format, based on the data regarding the position and shape of the pattern, by ink-jet means and then sucking ink on the engaging elements from the side of the rear surface so that the ink reaches the substrate sheet. Then the substrate sheet and the engaging elements are dyed so that a pattern of characters, design, symbol, etc. come out definitely.

In the meantime, recent advances of surface fasteners entirely molded of synthetic resin by injection molding are astonishing; as a result, in addition to molded surface fasteners having a certain degree of rigidness to be used as conventional industrial materials and interior ornamental goods, various molded surface fasteners having a very high degree of flexibility have been developed. Application of this flexible molded surface fasteners are on the increase for ordinary garments and daily goods strongly requiring high flexibility from a fashionability view point.

Nevertheless, all of the above-mentioned methods of forming an ornamental pattern are aimed at fiber surface fasteners. Practically, it is virtually impossible to adopt these methods in molded surface fasteners made by such as integral injection molding for the following reasons. Any effective ornamental pattern forming method for molded surface fasteners has not been established yet.

Although the method disclosed in Japanese Patent Publication No. Hei 3-79001 could be applied to the above-mentioned molded surface fastener, an ornamental pattern area would have bulged from the engaging surface of the surface fastener so that the engaging elements around the bulged ornamental pattern area would tend to fail to catch the engaging elements of a companion surface fastener when the two surface fasteners are pressed to engage, thus it is probable that a desired engaging strength required in the surface fastener can not be achieved.

Assuming that the methods disclosed in Japanese Patent Laid-Open Publications Nos. Sho 62-19105 and Hei 3-69658 could be applied to the molded surface fastener, since the substrate sheet of the integrally molded surface fastener is a molded sheet of synthetic resin, it would have been impossible to absorb dye liquid or ink through the molded substrate sheet unlike the woven or knit fiber substrate sheet having minute gaps.

SUMMARY OF THE INVENTION

It is therefore an object of this invention to provide a molded surface fastener which has a neat and clear ornamental pattern without the risk of reducing the rate of engagement with a companion surface fastener.

Another object of the invention is to provide a useful method and apparatus for efficiently manufacturing the above-mentioned molded surface fastener.

According to a first aspect of the invention, the above first-named object is accomplished by a molded surface fastener comprising: a substrate sheet having a multiplicity of engaging elements standing on an engaging surface of said substrate sheet; and a desired ornamental pattern is formed as a part of said engaging elements on said engaging surface of said substrate sheet by an area of said engaging surface which is devoid of said engaging elements. If necessary, a desired ornamental pattern of dent may be formed on the rear surface, which is opposite to the engaging surface, of the substrate sheet.

According to a second aspect of the invention, the above second-named object is accomplished by an apparatus for continuously molding a synthetic resin surface fastener having a multiplicity of engaging elements molded on an engaging surface of a substrate sheet. The apparatus comprises: a die wheel having a multiplicity of engaging-element-forming cavities arranged throughout its circumferential surface except areas where a desired ornamental pattern is formed by flat surfaces which has no engaging-element-forming cavities; drive means for driving the die wheel to rotate; supply means for continuously applying molten resin to the circumferential surface of the die wheel by a predetermined width; pressing means for filling the molten resin in the engaging-element-forming cavities in the circumferential surface of the die wheel under a predetermined pressure and continuously molding the substrate sheet in a predetermined thickness on the circumferential surface of the die wheel; guide means for guiding, in response to the rotation of the die wheel, the molded substrate sheet and the molded engaging elements circumferentially of the die wheel by a predetermined angle; and take-up means for drawing the molded engaging elements successively off the engaging-element-forming cavities after the guiding and positively removing the molded engaging elements, together with the molded substrate sheet, from the die wheel.

Preferably, the ornamental pattern of flat area of the circumferential surface of the die wheel is defined by combining a plurality of first discs, each having a multiplicity of cutouts in its circumferential edge surface at a predetermined pitch, each cutout defining the engaging-element-forming cavities, with a plurality of second discs partly devoid of the cutouts, in a laminated form. Alternatively, the ornamental pattern of flat surfaces is defined by covering part of the multiplicity of engaging-element-forming cavities formed on the circumferential surface of the die wheel with a covering member, or by packing part of the cavities with filler material.

Further, the supply means for the molten resin is an injection nozzle disposed with a predetermined gap with respect to the circumferential surface of the die wheel for continuously injecting the molten resin radially of the die wheel. Further, the pressing means is an injection resin pressure for the molten resin to be injected from the injection nozzle. The apparatus further includes dent impressing means disposed downstream of the injection nozzle in a direction of rotation of the die wheel for impressing a pattern of dent on a rear surface of the molded substrate sheet being guided circumferentially of the die wheel in response to the rotation of the die wheel.

Alternatively, the pressing means is a pressure roller disposed with a predetermined gap with respect to the circumferential surface of the die wheel and having an axis of rotation parallel to the axis of rotation of the die wheel, the pressure roller being to be driven for rotation in synchronism with the rotation of the die wheel. And the supply means for the molten resin is an extrusion die for continuously extruding the molten resin to the gap between the die wheel and the pressure roller. The pressure roller has on its circumferential surface a pattern of projection for impressing a pattern of dent on the rear surface of the molded substrate sheet of the molten resin.

Preferably, the apparatus further includes paint applying means for applying paint to an ornamental-pattern-impressing surface of the dent impressing means. The dent impressing means is a pattern-impressing roller having on its circumferential surface a pattern of projection and rotatable in synchronism with the rotation of the die wheel. The pattern-impressing roller is movable toward and away from the circumferential surface of the die wheel. Alternatively, the dent impressing means is an endless belt having on its circumferential surface a pattern of projection and rotatable in synchronism with the rotation of the die wheel. The endless belt is movable toward and away from the circumferential surface of the die wheel.

According to a third aspect of the invention, the above second-named object is accomplished by a method for continuously molding a synthetic resin surface fastener having a multiplicity of engaging elements integrally molded on an engaging surface of a substrate sheet. The method comprises the steps of: forming a desired pattern in a circumferential surface of a die wheel having a multiplicity of engaging-element-forming cavities by flat surfaces having no engaging-element-forming cavities; driving the die wheel to rotate while cooling at a predetermined temperature; continuously supplying molten resin to the circumferential surface of the die wheel in rotation by a predetermined width by supply means; filling the molten resin in the engaging-element-forming cavities of the circumferential surface of the die wheel under a predetermined pressure to mold a multiplicity of engaging elements and, at the same time, continuously molding a substrate sheet in predetermined thickness on the circumferential surface; guiding, in response to the rotation of the die wheel, the molded substrate sheet and the engaging elements circumferentially of the die wheel by a predetermined angle; and drawing the molded and guided engaging elements successively off the engaging-element-forming cavities after the guiding and positively removing the molded engaging elements, together with the molded substrate sheet, from the die wheel.

The method further includes the step of impressing a pattern of dent on a rear surface of the molded substrate sheet being guided circumferentially of the die wheel in response to the rotation of the die wheel, by dent impressing means disposed downstream of the injection nozzle in a direction of rotation of the die wheel.

Still further, the method includes the step of applying paint to an ornamental-pattern-impressing surface of the dent impressing means by paint applying means.

DETAILED DESCRIPTION OF THE PREFERRED EMBODIMENTS

Figure 1:
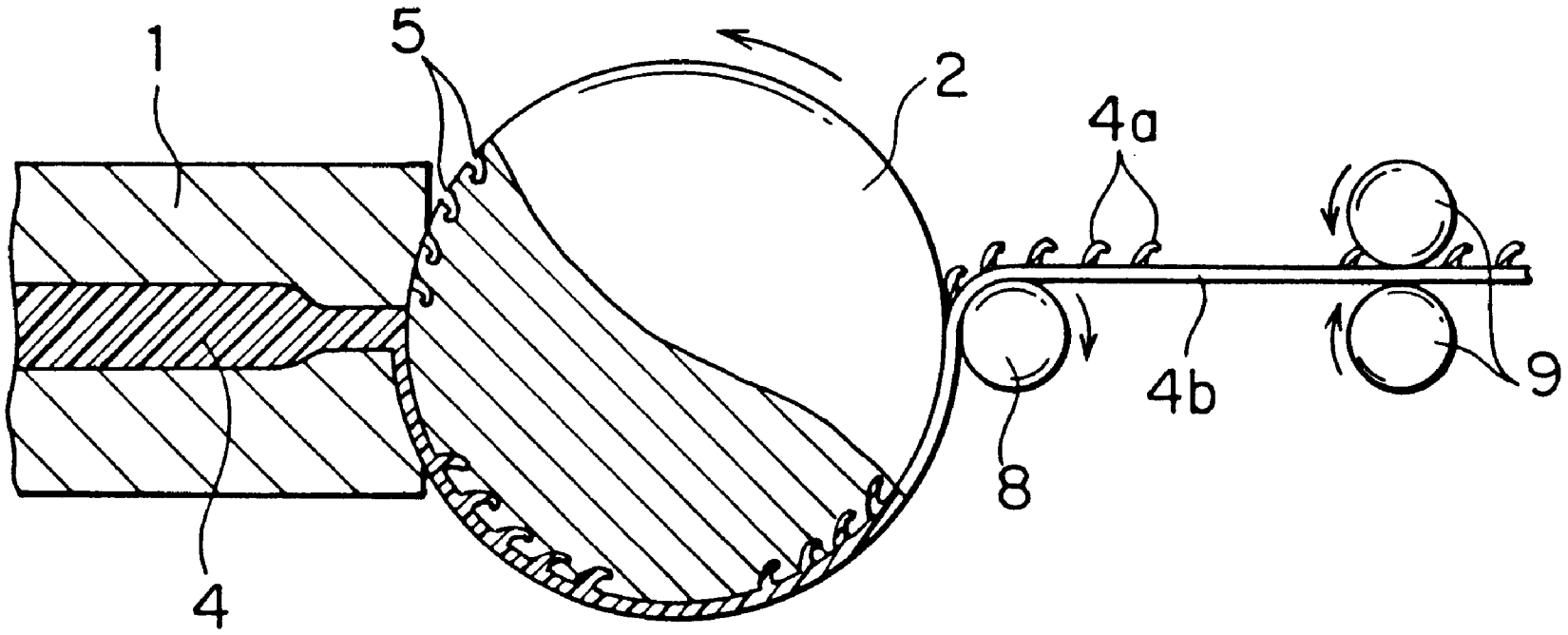
FIG. 1 is a fragmentary side view, partially in cross section, of a typical surface fastener molding apparatus for carrying out a method of this invention.

Various preferred embodiments of this invention will now be described in detail with reference to the accompanying drawings. FIG. 1 is a fragmentary side view, partially in cross section, of an injection molding apparatus according to a typical embodiment of this invention, showing the manufacturing process in which an ornamental pattern, such as, characters, design, symbol, etc., on the engaging surface of a molded surface fastener.

First of all, a fixed quantity of molten resin 4 extruded from a non-illustrated extruder is continuously injected from an injection nozzle 1 directly to the circumferential surface of a die wheel 2 under a predetermined resin pressure by a predetermined width. The die wheel 2 is rotated in the direction of an arrow in FIG. 1 by a non-illustrated drive source; the injected molten resin 4 attached in a sheet shape to the circumferential surface of the die wheel 2 is moved in response to the rotation of the die wheel 2. During this moving, the molten resin 4 is cooled to become solidified on the circumferential surface of the die wheel 2, which is cooled by a non-illustrated cooler disposed inside the die wheel 2. The circumferential surface of the die wheel 2 has a multiplicity of hook-element-forming cavities 5 for forming hook elements 4*a,* i.e. engaging elements, of a surface fastener; a predetermined thickness of a substrate sheet 4*b* is molded on the circumferential surface of the die wheel 2 and, at the same time, the hook elements 4*a* are molded integrally with the substrate sheet 4*b* as the hook-element-forming cavities 5 are filled with the molten resin 4.

Figure 2:
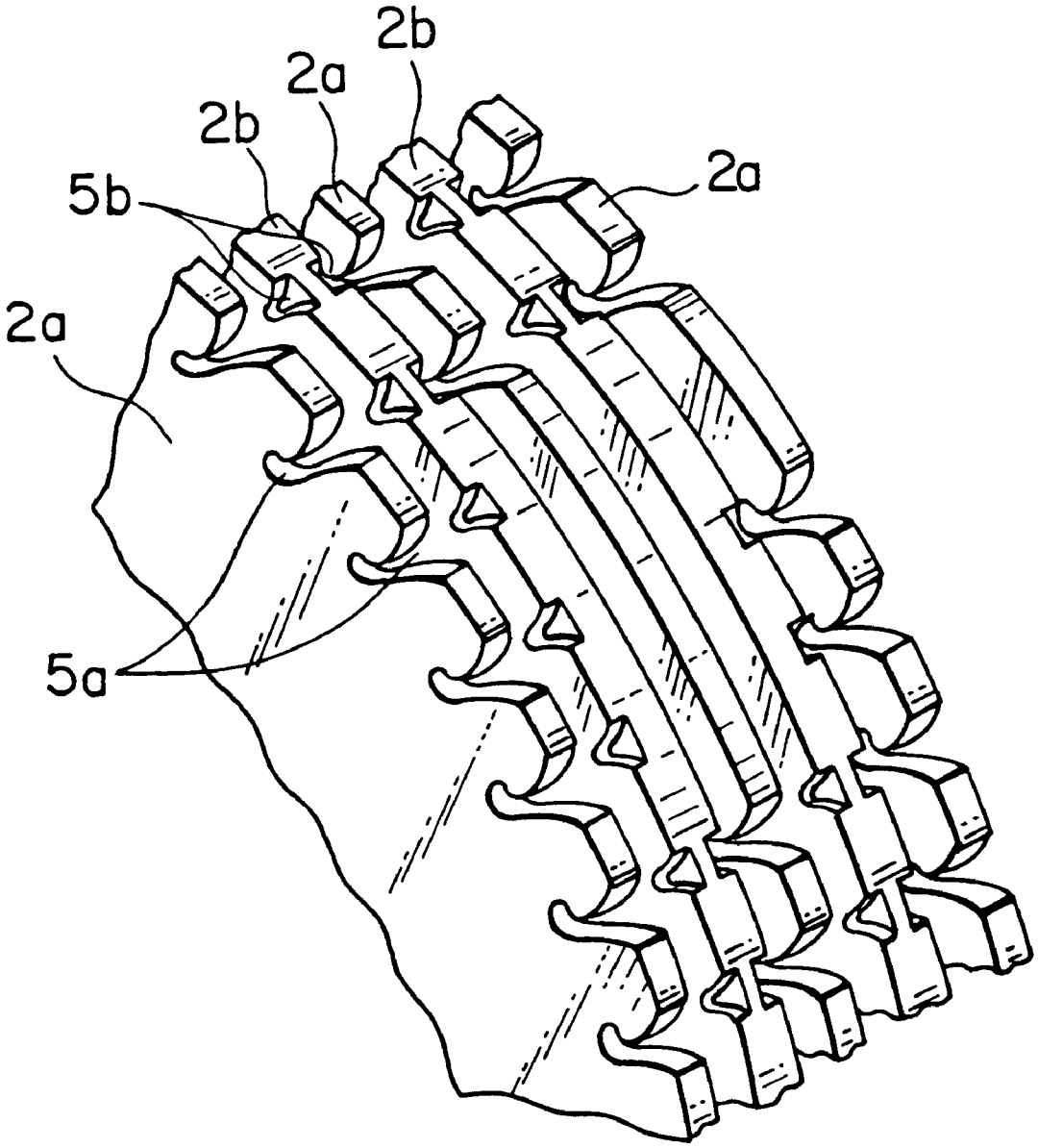
FIG. 2 is a fragmentary, exploded perspective view showing one example of combination of ring-shaped discs constituting a die wheel to be used in the method of this invention.

The basic structure of the die wheel 2 is a hollow cylindrical drum form in which a multiplicity of alternately arranged ring-shape discs 2*a,* 2*b* having a common diameter are placed one over another along its axis of the drum as shown, on enlarged scale, in FIG. 2. Each of every other discs 2*a* has a multiplicity of hook-body-forming cavities 5*a* each extending substantially radially in a hook-shape curve and opening to the circumferential edge, while each of the remaining discs 2*b* has a multiplicity of reinforcing-rib-forming cavities 5*b* in alignment with the respective hook-body-forming cavities 5*a* of its adjacent disc 2*a.* The hook-body-forming cavities 5*a* of one disc 2*a* and the reinforcing-rib-forming cavities 5*b* of adjacent discs 2*b* jointly define a multiplicity of composite cavities as the hook-element-forming cavities 5. In the illustrated example, the reinforcing-ribs-forming cavities 5*b* are formed on both the front and rear surfaces of a single disc 2*b*. Alternatively, the reinforcing-rib-forming cavities 5*b* may be formed in the circumferential edge of a single disc 2*b* as cutouts, and this single disc 2*b* may sandwich a flat disc devoid of any cavities on either surface.

The circumferential surface of the die wheel 2 of this invention has areas where no hook-element-forming cavity exists. Accordingly, the surface fastener would have areas with hook elements 4*a* and areas without hook elements 4*a.* The hook-element-free areas serves to form a desired ornamental pattern in the engaging surface of the molded surface fastener.

Figure 3:
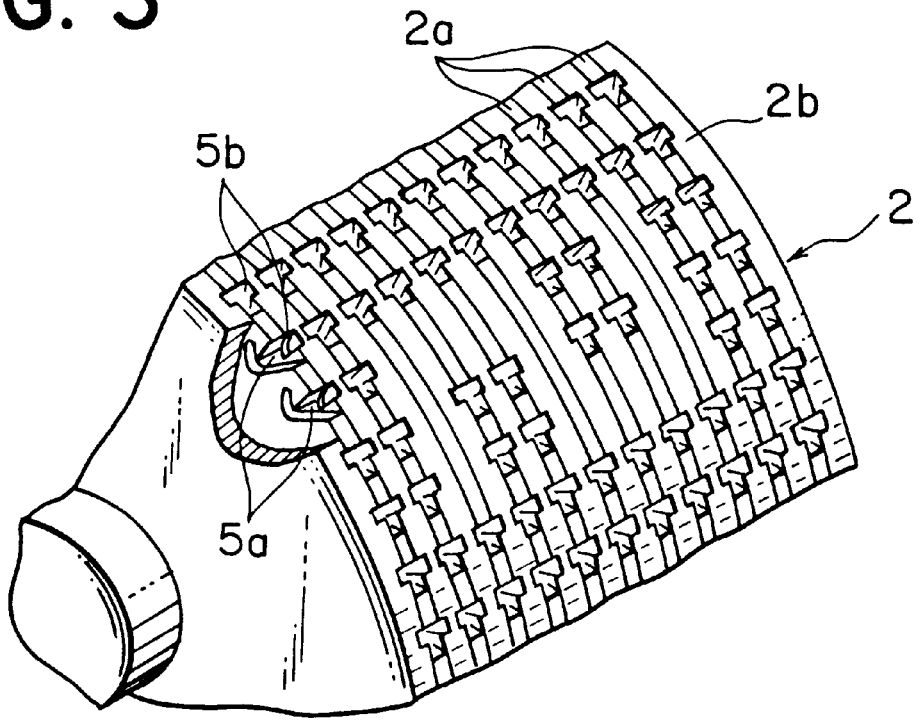
FIG. 3 is a fragmentary perspective view of the die wheel.
Figure 4:
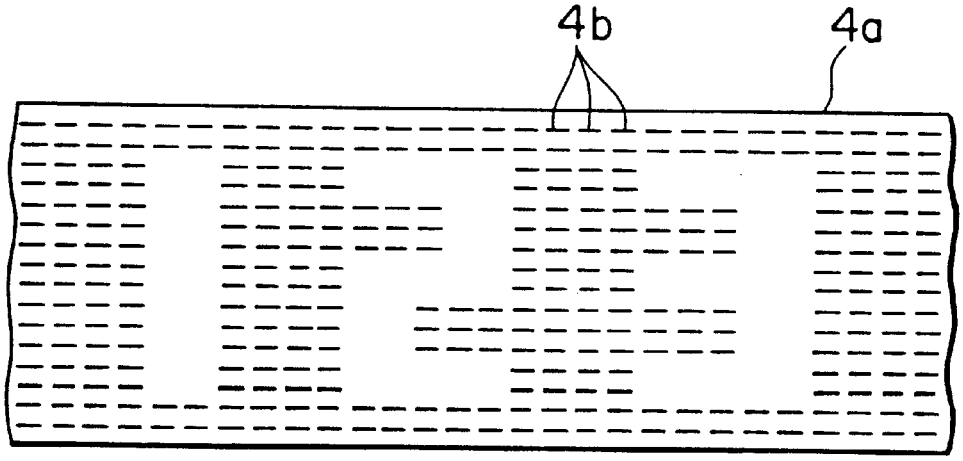
FIG. 4 is a fragmentary plan view showing a molded surface fastener manufactured using the die wheel.

In this embodiment, as shown in FIGS. 2 and 3, the cavity-free areas are constituted by omitting some of the hook-body-forming cavities 5*a* and reinforcing-rib-forming cavities 5*b*, which should originally have been formed at regular pitch in the circumferential edges of the two kinds of discs 2*a*, 2*b*. These cavity-free areas are distributed arbitrarily; practically, a large number of sets of discs identical and different in distribution are previously prepared so that an appropriate combination of discs 2*a*, 2*b* can be selected to distribute the cavity-free areas in a desired pattern on the circumferential surface of the die wheel 2, thus realizing a desired ornamental pattern in the engaging surface of a molded surface fastener.

FIG. 3 shows an example in which the cavity-free areas are distributed in a pattern of "2" on the circumferential surface of the die wheel 2 by selecting a corresponding combination of a large number of discs 2*a*, 2*b*. According to the die wheel 2 having such circumferential surface, a pattern of, for example, "1, 2, 3" come out in the engaging surface of the molded surface fastener.

Figure 7:
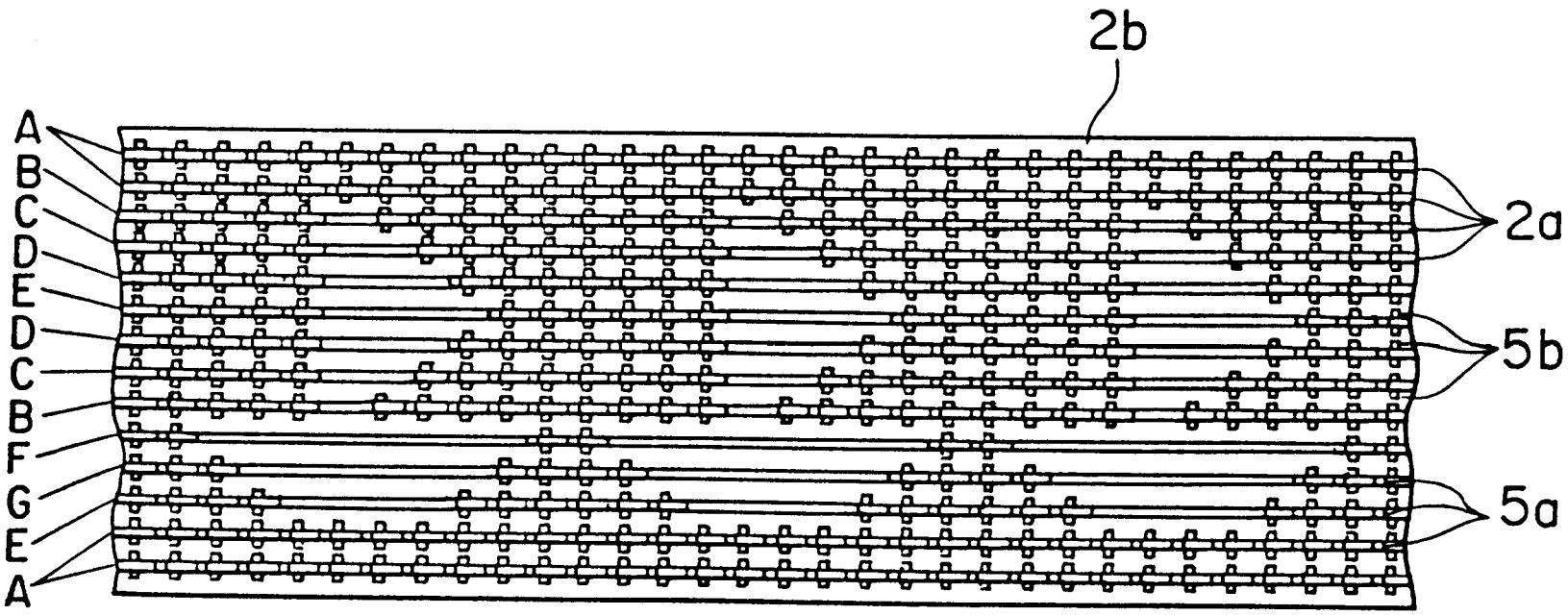
FIG. 7 is a developed plan view of the circumferential surface of a modified die wheel.
Figure 8:
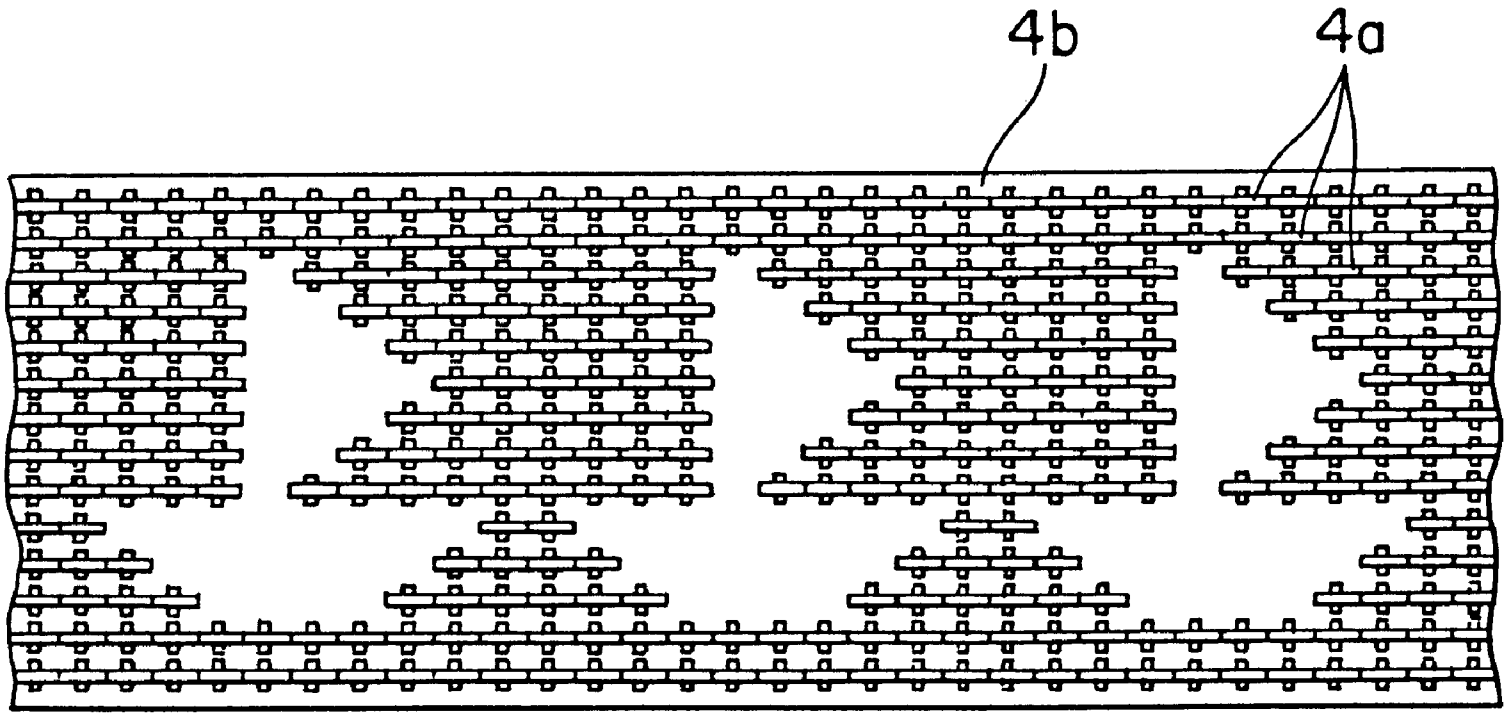
FIG. 8 is a fragmentary plan view showing a molded surface fastener manufactured using the modified die wheel.

FIG. 7 is a developed plan view of the die wheel 2 having a different circumferential surface. As shown in FIG. 7, in order to constitute the illustrated circumferential surface of the die wheel 2, fourteen discs 2*a* each having hook-body-forming cavities 5*a* and fifteen discs 2*b* each having reinforcing-rib-forming cavities 5*b* are used. The fourteen discs 2*a* have seven different kinds of arrangement of the hook-body-forming cavities 5*b* as designated by A–G; as these different kinds of discs are selectively combined, a pattern of yachts is defined by the cavity-free areas as shown in FIG. 7. As a result, on the engaging surface of the molded surface fastener obtained using this die wheel 2, a pattern of yachts as defined by the areas devoid of hook elements 4*a* comes out as shown in FIG. 8.

Figure 9:
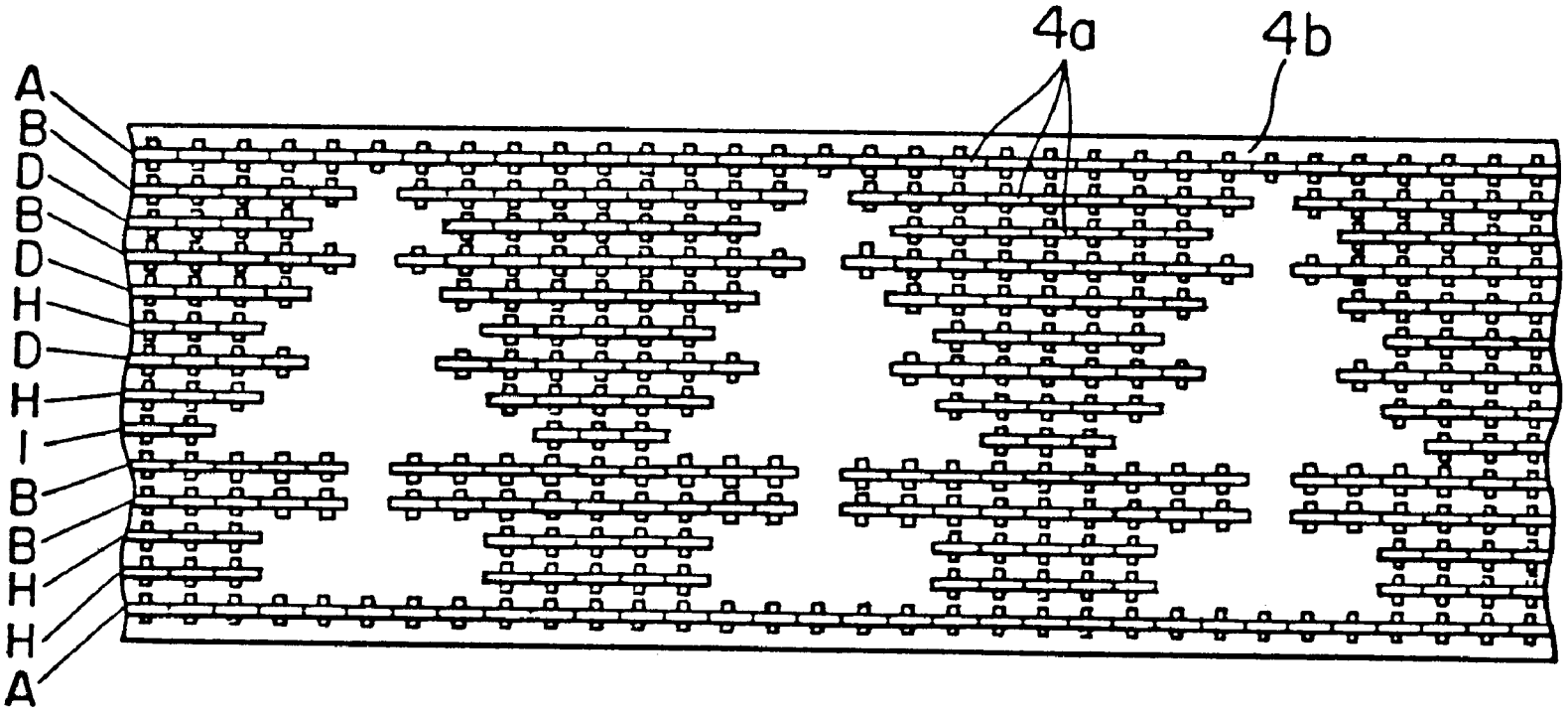
FIG. 9 is a fragmentary plan view similar to FIG. 8, but showing another molded surface fastener manufactured by another combination of ring-shaped discs constituting the die wheel.

FIG. 9 shows the engaging surface of a molded surface fastener molded by the die wheel 2 in which additional discs 2*a*, 2*b* different in arrangement of hook-element-forming cavities 5 from the foregoing discs 2*a*, 2*b*. As shown in FIG. 9, three kinds (A, B, D) of discs 2*a* are used out of the seven kinds (A–G), and additional two kinds (H, I) of discs 2*a* different in arrangement of hook-element-forming cavities 5 are used. As these different kinds of discs are selectively combined, a pattern of Christmas trees comes out on the engaging surface of the molded surface fastener.

According to this embodiment, by selecting a suitable combination from a large number of kinds of discs 2*a*, 2*b* previously prepared, it is possible to manufacture a surface fastener having a desired ornamental pattern of engaging-element-free areas in the engaging surface simultaneously with the molding.

Figure 5:
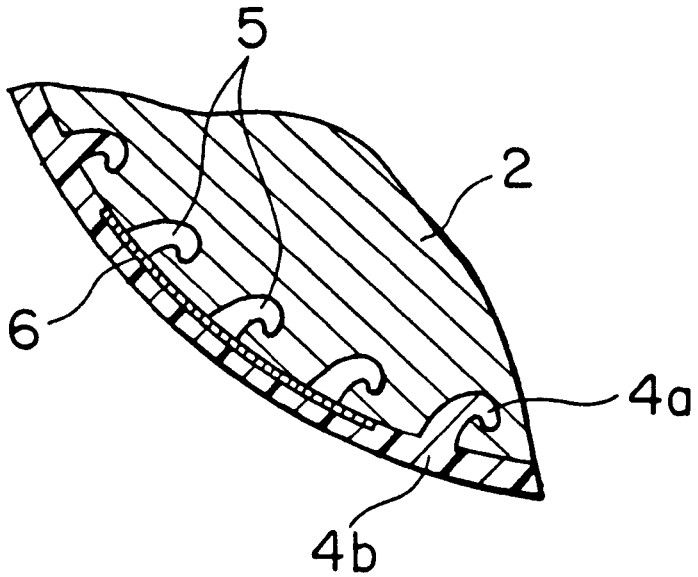
FIG. 5 is a fragmentary cross-sectional view showing another embodiment in which an ornamental pattern is formed on the circumferential surface of the die wheel.

FIG. 5 is a fragmentary cross-sectional view showing a modified die wheel 2 according to another embodiment in which the cavity-free areas are defined in a different way. As shown in FIG. 5, each and every one of discs 2*a*, 2*b* used in the die wheel 2 has hook-body-forming cavities 5*a* or reinforcing-rib-forming cavities 5*b* at regular pitch in its circumferential edge. Therefore, assuming the die wheel 2 is merely assembled, there exists no cavity-free area on its circumferential surface. According to this embodiment, a desired part of the hook-element-forming cavities 5 in the circumferential surface of the die wheel 2, which is obtained by thus combining the discs 2*a*, 2*b*, is covered by a covering 6 to close their openings. With part of the hook-element-forming cavities 5 thus covered, the molten resin is prevented from being supplied into the closed cavities 5 so that an ornamental pattern of a recess having a thickness equal to the thickness of the covering 6 is formed in the engaging surface of the substrate sheet 4*b.* At the areas covered by the covering 6, no hook elements 4*a* are molded, so the ornamental pattern as defined by the engaging-element-free areas comes out in the engaging surface of the molded surface fastener.

Figure 6:
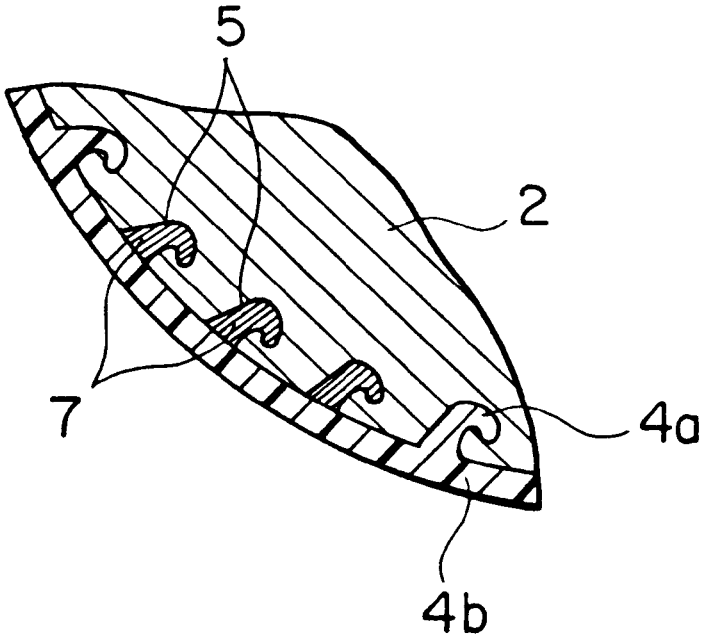
FIG. 6 is a fragmentary cross-sectional view similar to FIG. 5, but showing still another embodiment.

FIG. 6 is a fragmentary cross-sectional view similar to FIG. 5, but showing the die wheel 2 according to still another embodiment in which the cavity-free areas are defined in another different way. As shown in FIG. 6, each and every one of discs 2*a*, 2*b* used in the die wheel 2 has hook-body-forming cavities 5*a* or reinforcing-rib-forming cavities 5*b* at regular pitch in its circumferential edge.

Likewise the foregoing embodiment. Therefore, assuming the die wheel 2 is merely assembled, there exists no cavity-free areas on its circumferential surface. According to this embodiment, a desired part of the hook-element-forming cavities 5 in the circumferential surface of the die wheel 2, which is obtained by thus combining the discs 2*a*, 2*b*, is packed with filling material 7. The molten resin is prevented from being supplied into the closed cavities 5 thus packed with the filling material 7 so that no hook element 4*a* is formed in the closed areas and the ornamental pattern of engaging-element-free areas comes out in the engaging surface of the molded surface fastener. The filler material 7 is exemplified by clay, heat-resistant resin and paper.

As the die wheel 2 is rotated, the surface fastener continuously molded on the circumferential surface of the die wheel 2 and, at the same time, is moved circumferentially of the die wheel 2 by approximately 180°. Then the molded hook elements 4*a* standing on the engaging surface of the substrate sheet 4*b* are drawn successively off the hook-element-forming cavities 5 and are positively taken up, together with the substrate sheet 4*b*, from the circumferential surface of the die wheel 2 via a guide roller 8 by a pair of feed rollers 9, which are driven by non-illustrated drive means. As a result, the molded surface fastener having an ornamental pattern is continuously removed from the circumferential surface of the die wheel 2. In the illustrated example, the guide roller 8 is used. Alternatively, the guide roller 8 may be omitted depending on the position of the feed rollers 9.

Figure 10:
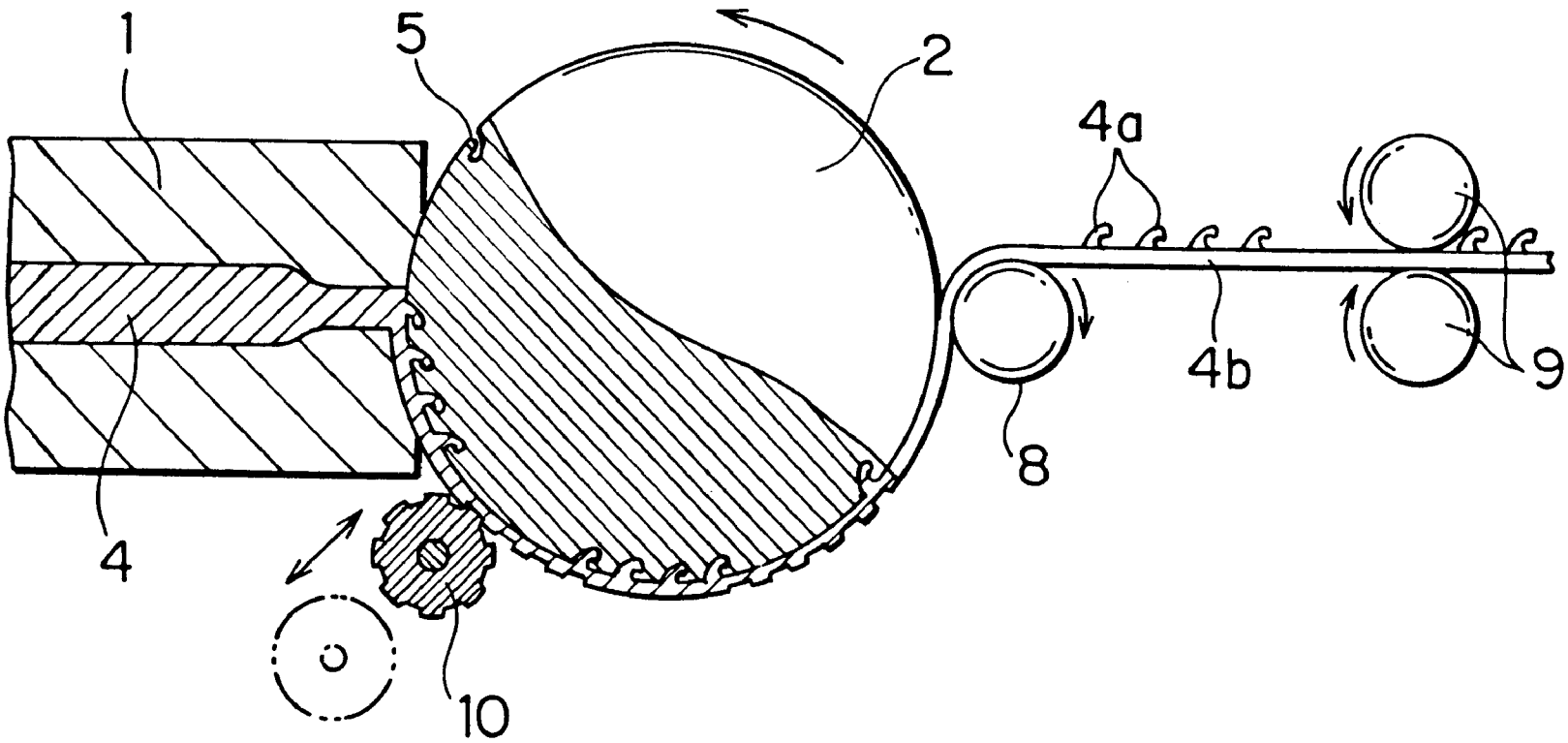
FIG. 10 is a fragmentary side, partially in cross section, showing a general construction of an apparatus for forming an ornamental pattern on the rear surface of a surface fastener by dent impressing means, in addition to the forming of the ornamental pattern by the die wheel.

FIG. 10 is a fragmentary side view, partially in cross section, of an apparatus for molding a surface fastener having an ornamental pattern on its engaging surface and, at the same time, forming characters, design, symbol, etc. on its rear surface.

Figure 13:
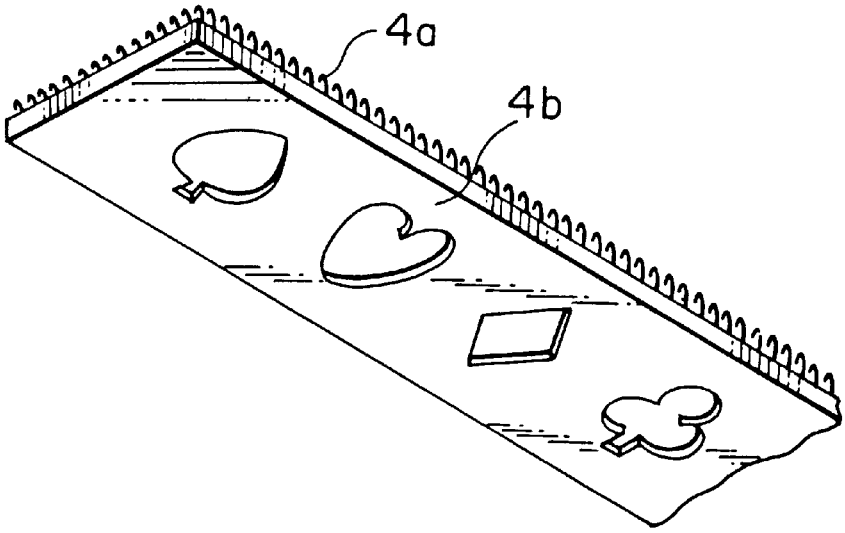
FIG. 13 is a rear perspective view of a molded surface fastener having an ornamental pattern formed on its rear surface.

The apparatus of this embodiment is substantially identical in basic structure with the previous embodiment. In addition to such structure, a pattern impressing roller 10 is disposed downstream of the injection nozzle 1 in the direction of rotation of the die wheel 2 and is movable toward and away from the circumferential surface of the die wheel 2. The pattern impressing roller 10 is freely rotatably supported and is rotatable in response to the rotation of the die wheel 2 while impressing a pattern on the rear surface of the substrate sheet of the surface fastener. The pattern impressing roller 10 has raised areas in a desired pattern on its circumferential surface; during molding, the raised areas are pressed against the rear surface of the substrate sheet 4*b* of a not yet solidified surface fastener, which substrate sheet is carried on the circumferential surface of the die wheel 2, under a predetermined pressure to form a pattern of dent on the rear surface of the substrate sheet 4*b* as shown in FIG. 13. In the illustrated example, the pattern impressing roller 10 is a small-size roller, but a diameter of the pattern impressing roller 10 may be selected arbitrarily. When the pattern should not be formed, the pattern impressing roller 10 is retracted to a waiting position as indicated by phantom lines.

Figure 11:
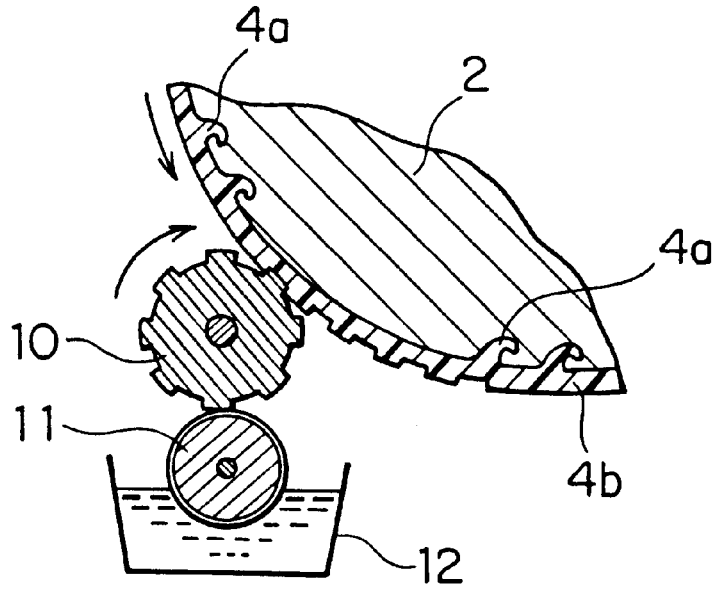
FIG. 11 is a fragmentary cross-sectional view showing another embodiment of the apparatus of FIG. 10.

FIG. 11 is a fragmentary cross-sectional view showing a modified pattern impressing unit for not only forming an ornamental pattern of dent by the pattern impressing roller 10 but also coloring the dent. In this embodiment, a painting roller 11 is disposed normally in contact with the raised areas of the circumferential surface of the pattern impressing roller 10, and lower part of the painting roller 11 is dipped in a paint bath 12. Preferably, the circumferential surface of the painting roller 11 is covered by a porous sheet, such as sponge or non-woven cloth, in order to transfer paint reliably. In this embodiment, the painting roller 11 transfers paint from its circumferential surface to the raised areas of the pattern impressing roller 10, while the pattern impressing roller 10 in turn transfers the paint from its raised areas to the surface of the dent to give a desired color to the pattern of dent.

Figure 12:
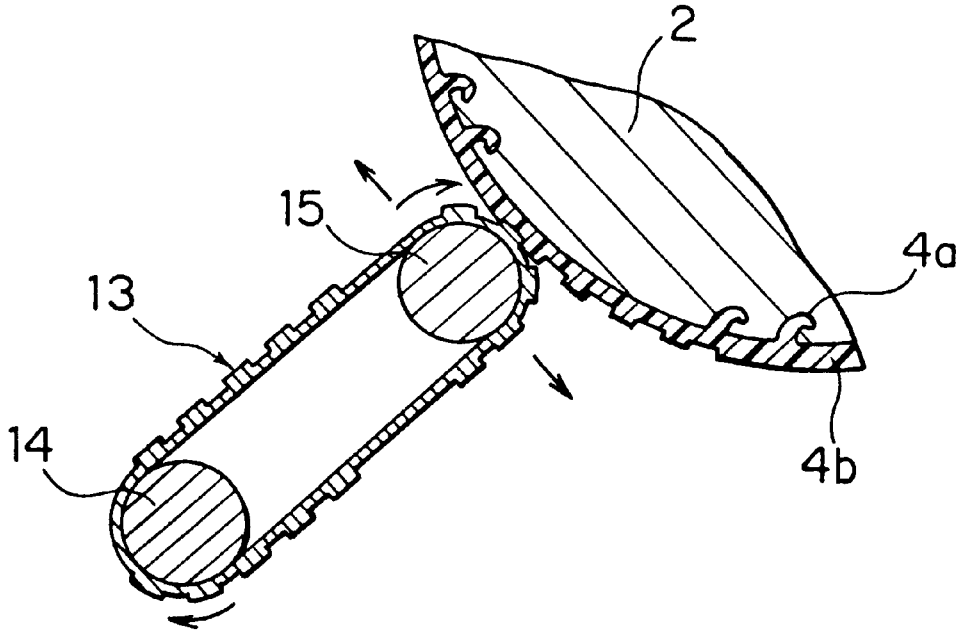
FIG. 12 is a fragmentary cross-sectional view showing a still another embodiment of the apparatus of FIG. 10.

FIG. 12 is a fragmentary cross-sectional view showing another modified apparatus for molding a surface fastener having an ornamental pattern on its engaging surface and, at the same time, forming characters, design, symbol, etc. on its rear surface of the molded surface fastener.

According to this embodiment, an endless belt 13 is substituted for the pattern impressing roller 10. The endless belt 13 is made of metal or heat-resistant synthetic resin and has a desired pattern of raised areas on its surface, being supported by a driven roller 14, which is driven to rotate in synchronism with the rotation of the die wheel 2, and a follow roller 15. Using such endless belt 11, it is possible to increase the area of a pattern and realize a wide selection of patterns as compared to using the pattern impressing roller 10. Also in this embodiment, the painting roller 11 may be disposed in contact with the circumferential surface of the endless belt 13.

Figure 14:
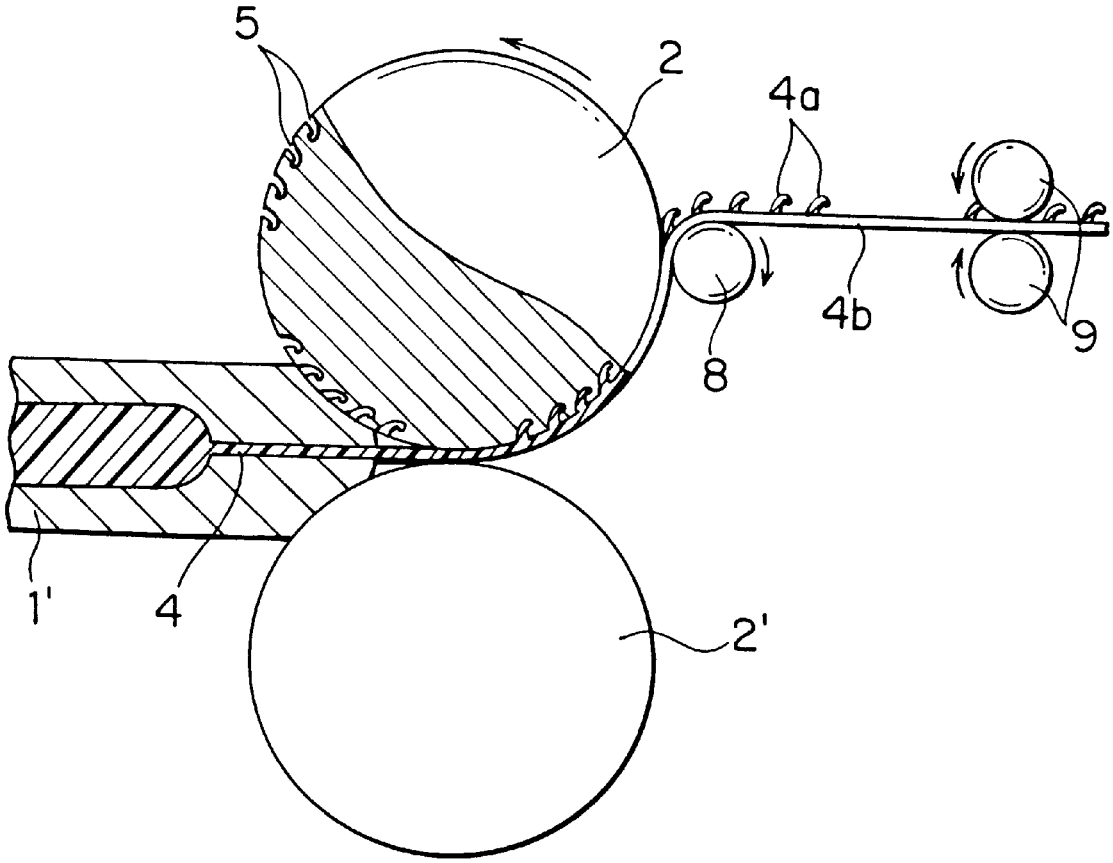
FIG. 14 is fragmentary side view, partially in cross section, showing an example of another typical construction for carrying out method of this invention.

FIG. 14 show still another modified apparatus for manufacturing a molded surface fastener according to still another embodiment. As shown in FIG. 14, a pressure roller 2' having a flat surface parallel to the axis of rotation of the die wheel 2 is disposed, and an extrusion die 1' is disposed to face a gap between the die wheel 2 and the pressure roller 2' for extruding molten resin 4 toward the gap to continuously mold a surface fastener having the above-mentioned structure between the die wheel 2 and the pressure roller 2'. In this embodiment, when the above-mentioned ornamental pattern is to be formed also on the rear surface of the surface fastener, the pressure roller 2' may have a pattern or raised areas on its circumferential surface.

As is apparent from the foregoing description, since the synthetic resin molded surface fastener of this invention has the desired pattern formed of areas devoid of engaging elements 4*a* in its engaging surface, there is no risk of obstructing engagement with a companion surface fastener. Further, a desired degree of engaging strength is secured since the ornamental pattern of areas are formed by omitting redundant engaging elements 4*a*. And since a clear-cut ornamental pattern comes out in the engaging surface, very fashionable products can be realized. In the case that the surface fastener is molded of transparent material, by forming an ornamental pattern of dent in the rear surface of the substrate sheet 4*b* of the surface fastener in addition to the ornamental pattern in the engaging surface, it is possible to obtain a more sophisticated unique product as the ornamental pattern of the rear surface can be seen through from the front side, overlapping the ornamental pattern of the front surface.

According to the integrally molded surface fastener manufacturing method of this invention, it is possible to mold a surface fastener in a single step and, at the same time, to form a clear-cut ornamental pattern in either of the engaging surface and the rear surface simply. Furthermore, it is possible to manufacture a surface fastener that can secure a desired degree of engaging strength even though the ornamental pattern is formed, which is particularly useful from an economical point of view.

What is claimed is:

1. A molded surface fastener comprising:

a substrate sheet having an engaging surface having a multiplicity of engaging element locations; and a multiplicity of engaging elements standing on said engaging surface of said substrate sheet at a plurality of said engaging element locations;

wherein a desired ornamental pattern is formed as a part of said engaging elements on said engaging surface of said substrate sheet by an area of said engaging surface which is devoid of said engaging elements, said area defined by preselected element engaging locations on said engaging surface, said engaging elements located outside of an outer perimeter of said area of said engaging surface which is devoid of said engaging elements and circumscribing said area wherein the area which is devoid of said engaging elements has an outer perimeter within which at least substantially no engaging elements are formed.

2. A molded surface fastener according to claim 1, wherein said substrate sheet has on a rear surface opposite to said engaging surface a desired pattern of dent.

3. A molded surface fastener according to claim 2, wherein the desired pattern of dent has a desired color.

4. The molded surface fastener of claim 1, wherein the area which is devoid of said engaging elements is substantially centrally located within said engaging elements.

5. The molded surface fastener of claim 1, wherein the area devoid of said engaging elements has no engaging elements within the outer perimeter of the area devoid of engaging elements.

6. A molded surface fastener comprising:

a substrate sheet of a predetermined thickness and having an engaging surface covered by a multiplicity of engaging element locations, said substrate sheet continuously molded on a circumferential surface of a die wheel, said die wheel rotating in one direction and having on said circumferential surface thereof a multiplicity of engaging-element-forming cavities and flat surfaces without said engaging-element-forming cavities;

a multiplicity of engaging elements on a plurality of said engaging element locations of said engaging surface of said substrate sheet and formed by filling molten resin into said engaging-element-forming cavities; and a desired ornamental pattern formed on said engaging surface of said substrate sheet without engaging elements, said engaging elements located outside of an outer perimeter of said area of said engaging surface which is devoid of said engaging elements and circumscribing said area wherein the area which is devoid of said engaging elements has an outre perimeter within which at least substantially no engaging elements are formed.

7. A molded surface fastener according to claim 6, having a pattern of dent on a rear surface of said substrate sheet, wherein said pattern of dent is formed by a pattern impressing roller disposed downstream of the direction of rotation of said die wheel and having raised areas in a desired pattern on a circumferential surface of said pattern impressing roller, said pattern impressing roller being movable toward and away from the circumferential surface of said die wheel and impressing a pattern on the rear surface of said substrate sheet guided in a circumferential direction of said die wheel.

8. The molded surface fastener of claim 6, wherein the area which is devoid of said engaging elements is substantially centrally located within said engaging elements.

9. The molded surface fastener of claim 6, wherein the area devoid of said engaging elements has no engaging elements within the outer perimeter of the area devoid of engaging elements.

* * * * *